US006233763B1

(12) United States Patent
Spaan

(10) Patent No.: US 6,233,763 B1
(45) Date of Patent: May 22, 2001

(54) BLANKET WITH POCKETS AND BUTTONS FOR RETAINING AMUSEMENT FIGURES AND THE LIKE

(76) Inventor: Susan Spaan, 324 Owings Creek Rd., Hamilton, MT (US) 59840

( * ) Notice: Subject to any disclaimer, the term of this patent is extended or adjusted under 35 U.S.C. 154(b) by 0 days.

(21) Appl. No.: 09/580,004

(22) Filed: May 26, 2000

(51) Int. Cl.[7] ..... A47G 9/02
(52) U.S. Cl. ..... 5/485; 5/482; 5/907; 446/72
(58) Field of Search ..... 446/72, 77, 369, 446/73, 75; 5/639, 694, 482, 485, 486, 907

(56) References Cited

U.S. PATENT DOCUMENTS

| | | | | |
|---|---|---|---|---|
| 1,587,387 | * | 6/1926 | Lichtman | 5/482 X |
| 1,651,738 | | 12/1927 | Stein et al. . | |
| 2,619,771 | | 12/1952 | Jones . | |
| 2,628,452 | | 2/1953 | Gladstein . | |
| 2,655,762 | | 10/1953 | Burke . | |
| 3,447,165 | | 6/1969 | Brosk . | |
| 3,789,546 | | 2/1974 | Morrison . | |
| 4,138,745 | | 2/1979 | Greenspan . | |
| 4,172,300 | | 10/1979 | Miller . | |
| 4,654,906 | | 4/1987 | Roberts . | |
| 5,136,738 | | 8/1992 | Denson . | |
| 5,208,934 | * | 5/1993 | Bachnick et al. | 5/490 |
| 5,421,045 | * | 6/1995 | Bowen | 5/485 |
| 5,443,880 | | 8/1995 | Wike . | |
| 5,499,411 | | 3/1996 | Wong . | |
| 5,737,785 | | 4/1998 | Casey . | |
| 5,778,468 | * | 7/1998 | Saarela et al. | 5/639 X |
| 5,970,542 | | 10/1999 | Mays . | |
| 6,038,719 | * | 3/2000 | Castagna | 5/636 |
| 6,106,360 | * | 8/2000 | Jenkins et al. | 5/639 X |

* cited by examiner

*Primary Examiner*—Michael F. Trettel
(74) *Attorney, Agent, or Firm*—Blakely, Sokoloff, Taylor & Zafman LLP

(57) ABSTRACT

An improved blanket with an attached pocket for retaining an amusement figure is disclosed. A blanket comprising a pocket attached to a surface of the blanket, the pocket having an opening and an interior region; and an amusement figure positioned within the interior region of the pocket and having at least a portion of the amusement figure extending beyond the opening, a lower portion of the amusement figure being permanently attached to the blanket, the amusement figure being configured with enough material to enable limited range movement of the amusement figure outside of the opening.

15 Claims, 5 Drawing Sheets

BLANKET WITH POCKETS AND BUTTONS FOR RETAINING AMUSEMENT FIGURES AND THE LIKE

FIELD OF THE INVENTION

The present invention relates to blankets or quilts with pockets for retaining amusement figures and the like.

BACKGROUND OF THE INVENTION

The combination of pockets for retaining dolls or puppets is well known in the prior art. For example, U.S. Pat. No. 3,789,546 (the '546 patent) describes a doll and pillow combination wherein a baby doll is removably received on one side of the pillow in a pocket secured to a pillowcase. The doll and pocket are particularly configured so that a child may place a hand inside the doll and manipulate the same as a puppet. The '546 patent further describes complementary male/female snap means provided on the doll's garment and on the pillowcase within the pocket beneath a flap. Snap means removably secure the doll directly to the pillow within the pocket formed by the flap. Because the doll in the '546 patent must be configured to enable the hand of a child to occupy the interior space of the doll, the snap means in the '546 patent is particularly configured to not intrude into the interior space of the doll or the pocket.

U.S. Pat. No. 1,651,738 (the '738 patent) describes a doll and a bed with pillow or a cushion upon which the doll appears to lie, with the upper part of the body, head and arms exposed above what appear to be covers for the remainder of the body and such loose or flexible connection between the doll and the pillow or cushion as to permit movements, corresponding to an infant's movements, of the exposed members or parts, either by manipulation of the fingers thrust through the opening provided for that purpose in the bed or cushion and into contact or engagement with the head and arm members, as well as by mere shaking when grasping the bed or cushion by the hand. Thus, the '738 patent similarly describes a pillow or cushion including what appears to be a pocket in which a doll or puppet may be manipulated. Again, the apparatus described in the '738 patent is particularly adapted to enable movement of the doll or puppet through an opening provided for that purpose in the bed or cushion.

U.S. Pat. No. 2,628,452 (the '452 patent) describes a doll and doll pocket therefore. The invention in the '452 patent is a pocket or receptacle adapted to be applied to a garment for the reception and securing of a doll or animal figure therein, with the arms, legs, and head of the doll protruding therefrom. As described in the '452 patent, the doll body is inserted through the top slot of the pocket and the legs extend outwardly through bottom slots of the pocket and the doll is secured by means of the co-action of separable fastener portions, part of which are attached to the doll to be operable with other portions attached to the outer surface of the pocket. As described in the '452 patent, the separable fastener means must be located on the exterior of the pocket to enable the doll or animal figure to move within the pocket. Thus, the '452 patent envisions a doll or animal figure which is completely removable from the pocket upon disengagement of the fastener means.

Other prior art references, such as U.S. Pat. No. 5,737,785 (the '785 patent) describe various implementations of a blanket with pockets provided therein. However, the pocket provided in the blanket of the '785 patent is intended as a means for securely storing and carrying loose items to and from a beach or swimming pool. The pocket is not intended to retain a doll or stuffed animal.

Thus, a blanket with an attached pocket for retaining an amusement figure is needed.

SUMMARY OF THE INVENTION

An improved blanket with an attached pocket for retaining an amusement figure is disclosed. A blanket comprising a pocket attached to a surface of the blanket, the pocket having an opening and an interior region; and an amusement figure positioned within the interior region of the pocket and having at least a portion of the amusement figure extending beyond the opening, a lower portion of the amusement figure being permanently attached to the blanket, the amusement figure being configured with enough material to enable limited range movement of the amusement figure outside of the opening.

DETAILED DESCRIPTION OF THE PRESENT INVENTION

An improved blanket with an attached pocket for retaining an amusement figure is disclosed. In the following detailed description, numerous specific details are set forth in order to provide a thorough understanding of the present invention. However, it will be apparent to one of ordinary skill in the art that these specific details need not be used to practice the present invention. In other circumstances, well known structures, materials, and processes have not been shown or described in detail in order not to unnecessarily obscure the present invention.

Figure 1:
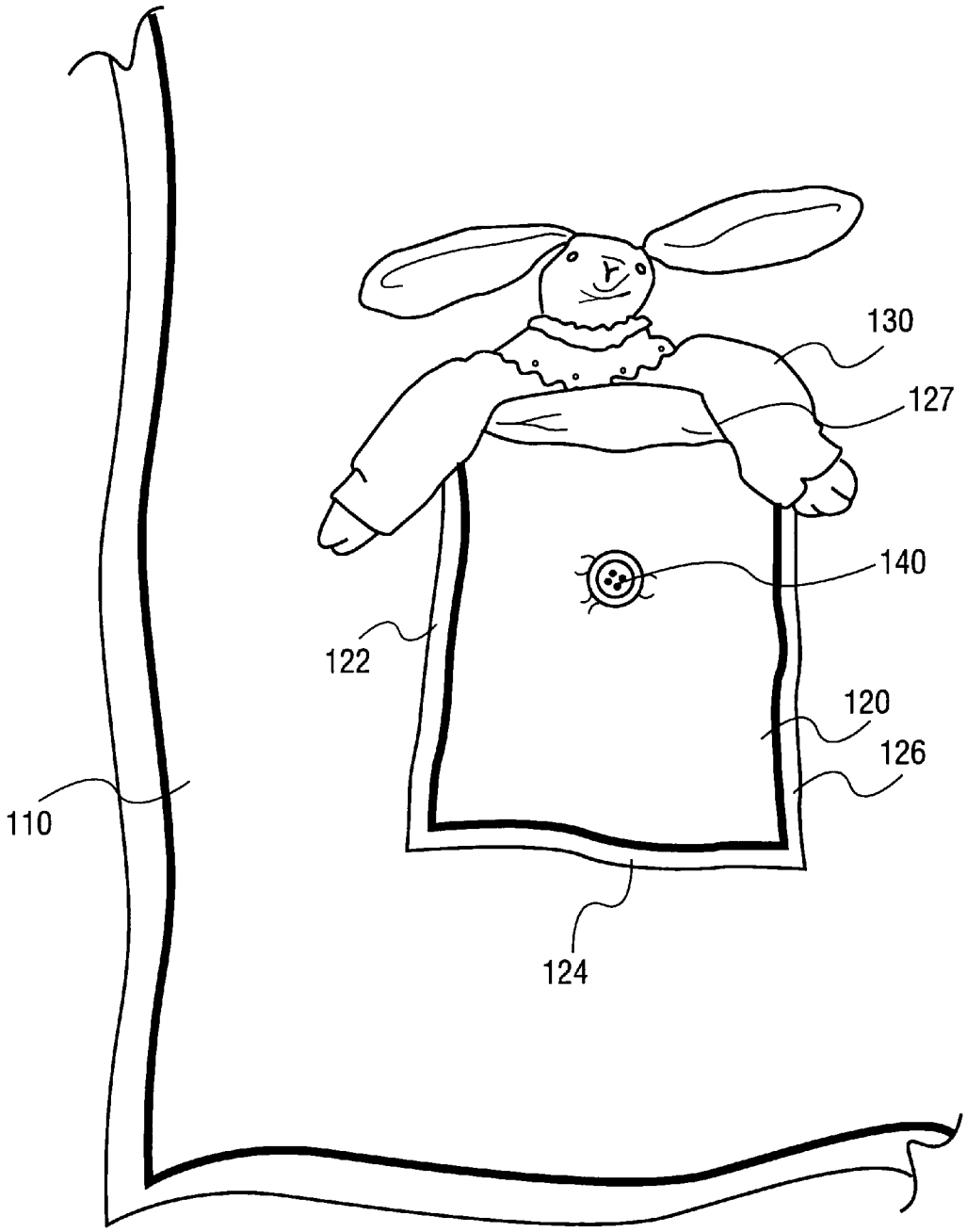
FIG. 1 illustrates one embodiment of the present invention with the amusement figure positioned within the pocket.

FIG. 1 illustrates one embodiment of the present invention. As shown, a blanket or quilt 110 is shown to which a pocket 120 has been attached. It will apparent to one of ordinary skill in the art that the blanket or quilt 110 may be any of a wide variety of blankets, quilts, comforters, bedspreads, or the like. It will also be apparent to one of ordinary skill in the art that pocket 120 can be attached to blanket 110 using a variety of conventional means, such as sewing, stitching, use of zippers, or the use of Velcro or chemical bonding agents. In the embodiment illustrated in FIG. 1, pocket 120 is attached to blanket 110 around three sides 122, 124, and 126, thereby leaving an opening along one side of the pocket indicated in FIG. 1 by reference number 127. Within the interior region created by this pocket 120, a stuffed animal, doll, puppet, or other type of amusement figure 130 may be inserted. As shown in FIG. 1, amusement figure 130 is partly contained within pocket 120 with a portion of amusement Figure 130 extending outside of opening 127 and a lower portion of amusement figure 130 contained within the interior region of pocket 120. As will be described in more detail below, button or fastener 140 is used to retain amusement figure 130 within pocket 120.

Figure 2:
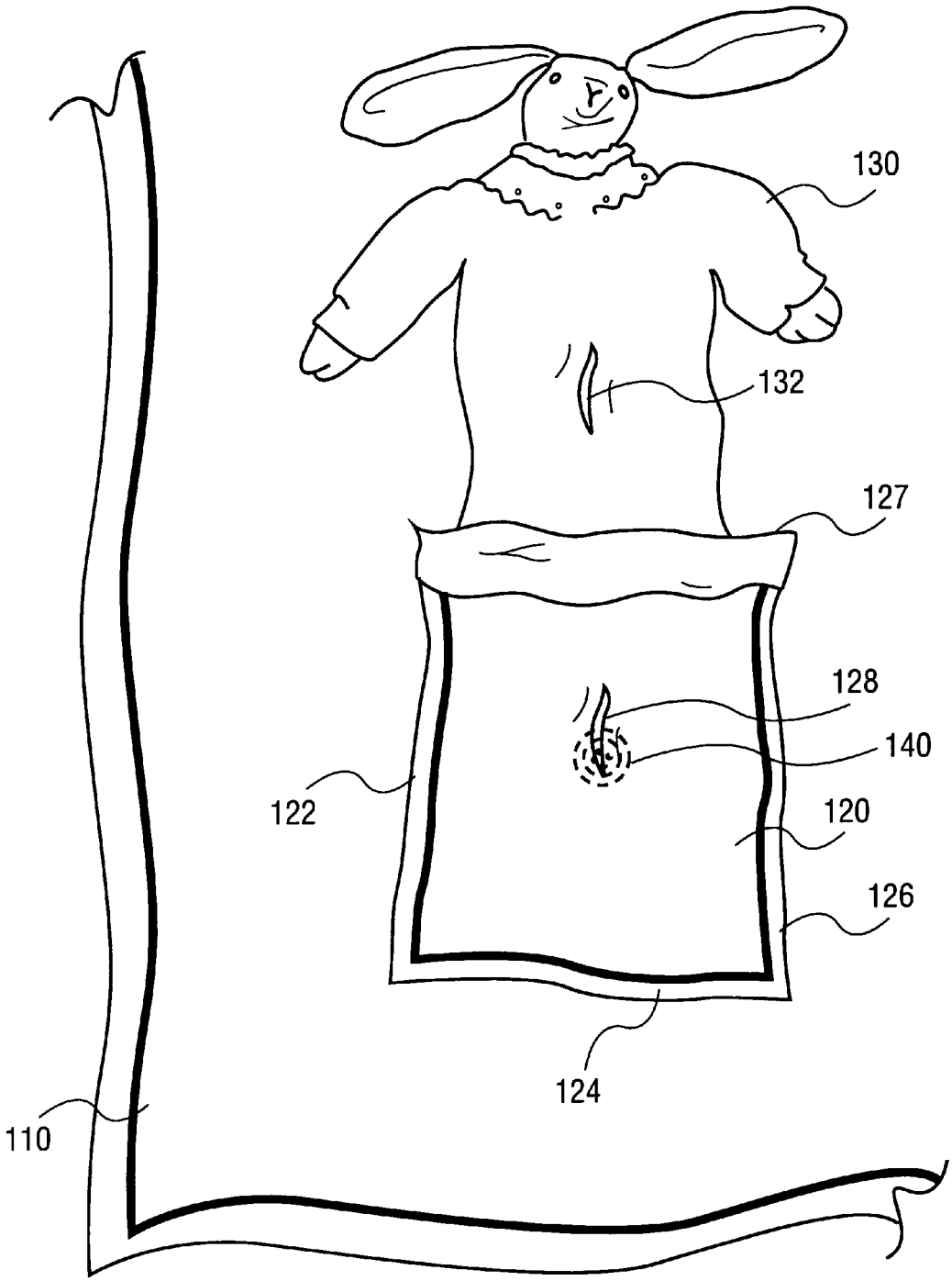
FIG. 2 illustrates one embodiment of the present invention with the amusement figure positioned outside of the pocket.

Referring now to FIG. 2, the embodiment of the present invention is shown with the amusement figure 130 having been disengaged from button 140 and fully extended outside the opening 127 of pocket 120. In the preferred embodiment of the present invention, the amusement figure 130, while able to be more fully extended outside of pocket 120, cannot be completely removed from pocket 120. As will be described and illustrated in more detail below, amusement figure 130 is permanently attached to blanket 110 at a lower portion of amusement figure 130 at the bottom side 124 of pocket 120. Buttonholes 132 and 128 are also shown in FIG. 2. Buttonhole 132 extends through a portion of amusement figure 130. Buttonhole 128 extends through the outer surface of pocket 120. Button or fastener 140, obscured in FIG. 2 by the lower portion of amusement figure 130 is permanently attached to blanket 110 at a location adjacent to buttonhole 128. As will be apparent to one of ordinary skill in the art, the amusement figure 130 may be retained within pocket 120 by aligning buttonhole 132 with buttonhole 128 and manipulating button 140 through buttonholes 132 and 128 thereby producing the configuration of this embodiment of the present invention as shown in FIG. 1.

Figure 3:
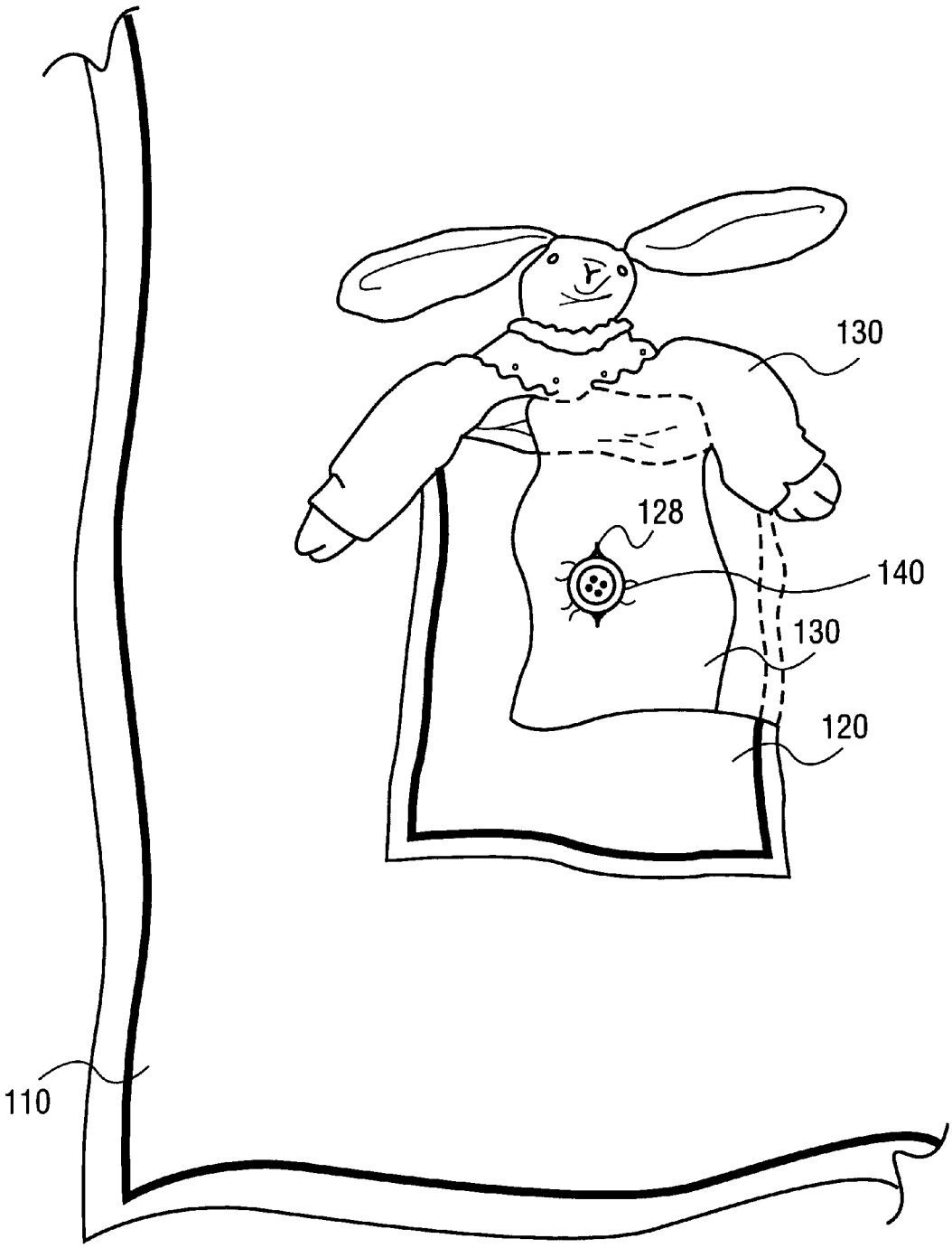
FIG. 3 is a cutaway view showing the buttoned amusement figure within the pocket.

Referring to FIG. 3, a cutaway of the pocket 120 with the amusement figure 130 retained therein is shown. As illustrated, a portion of amusement figure 130 is retained within an interior region of pocket 120. In the configuration shown in FIG. 3, button 140 has been manipulated through buttonholes 132 and 128 to retain amusement figure 130 within pocket 120.

Figure 4:
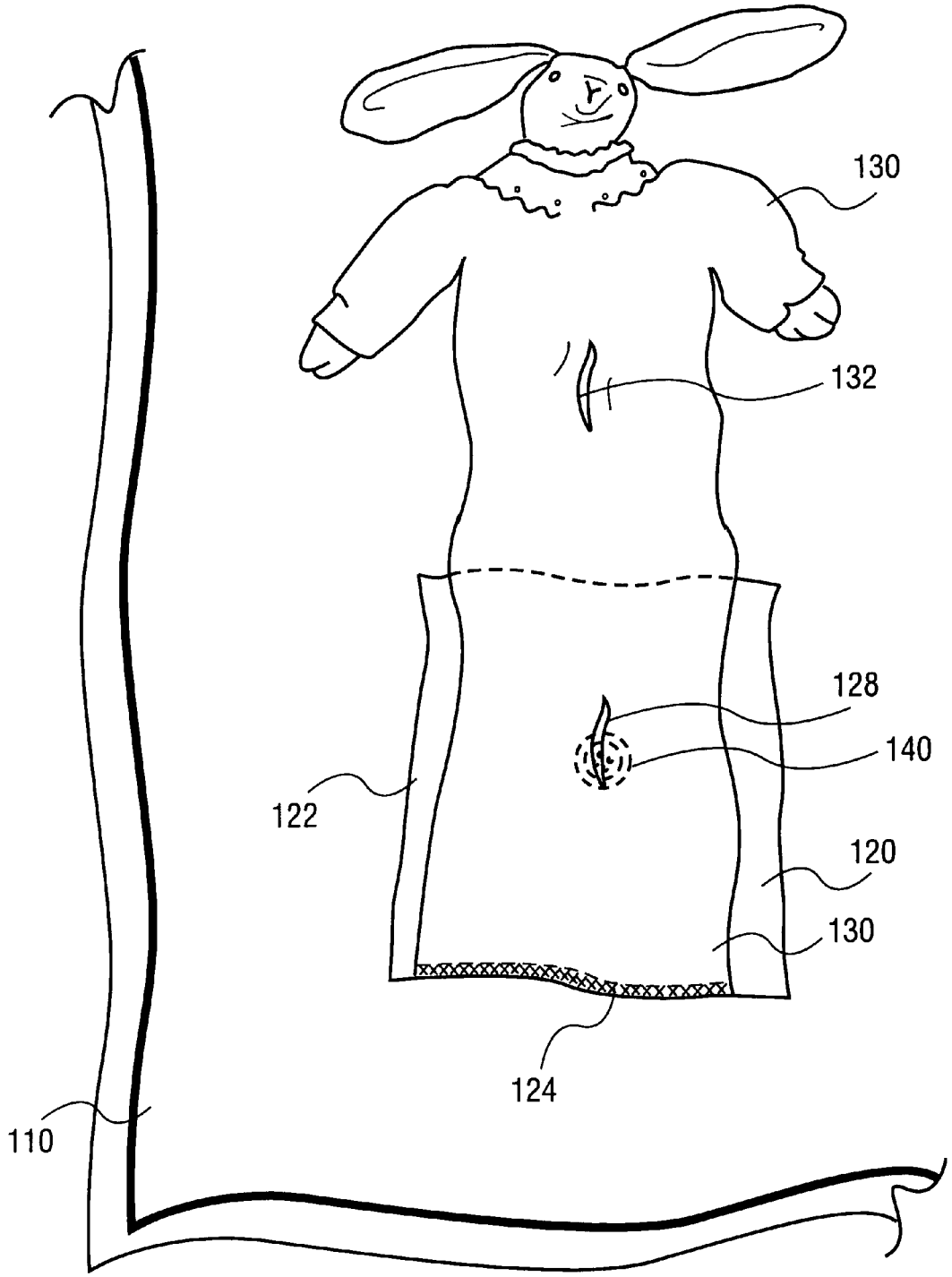
FIG. 4 is a cutaway view showing the unbuttoned amusement figure within the pocket.

Referring now to FIG. 4, the embodiment of the present invention is shown with a cutaway view showing the interior region of pocket 120. As shown, the amusement figure 130 includes enough material to enable the extension of amusement figure out of pocket 120 for a limited range. A lower edge of amusement figure 130 is permanently attached to blanket 110 and pocket 120 at edge 124. It will be apparent to one of ordinary skill in the art that amusement figure 130 may be permanently attached to blanket 110 using well-known sewing, stitching, or other fabric bonding processes. Because amusement figure 130 is permanently attached to blanket 110, the amusement figure 130 cannot be inadvertently separated from blanket 110. In this manner, the amusement figure of the present invention is always available for the amusement of those using the invention. Although the amusement figure 130 of the present invention includes enough material at its lower end to enable the extension of the amusement figure 130 outside of pocket 120 for a limited range, the fabric from which the amusement FIG. 130 is made nevertheless enables the compression of the fabric into pocket 120 to a degree enabling the alignment of buttonhole 132 with buttonhole 128 so that button 140 can be manipulated there between enabling the retention of amusement figure 130 within pocket 120.

Figure 5A:
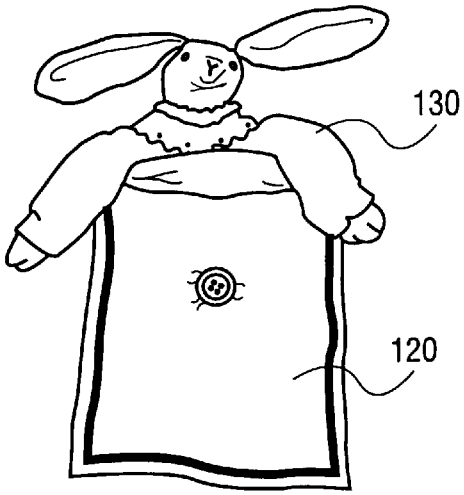
FIGS. 5A, 5B, and 5C illustrate various alternative embodiments of the present invention.
Figure 5B:
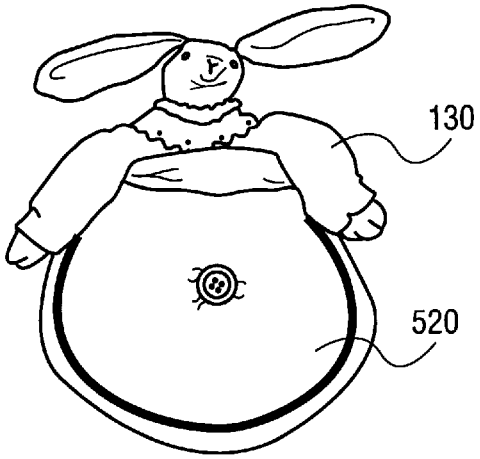
Figure 5C:
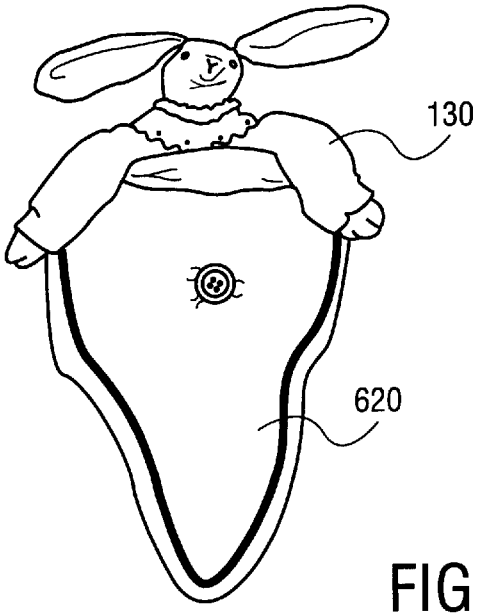

Referring to FIGS. 5A, 5B, and 5C, various alternative embodiments of the present invention are illustrated. In FIG. 5A, a conventional rectangular pocket 120 is illustrated. In FIG. 5B, a circular or oval-shaped pocket 520 is illustrated. Using the same techniques described and illustrated above, the amusement figure 130 is similarly permanently attached to blanket 110 at a lower edge of pocket 520. In a third alternative embodiment, a pointed or angular configuration of pocket 620 is illustrated. Similarly, the amusement figure in FIG. 5C is permanently attached to the blanket 110 and pocket 620.

Thus, an improved blanket with an attached pocket for retaining an amusement figure is disclosed. Although the present invention is described herein with reference to a specific preferred embodiment, many modifications and variations therein will readily occur to those with ordinary skill in the art. Accordingly, all such variations and modifications are included within the intended scope of the present invention as defined by the following claims.

What is claimed is:

1. A blanket comprising:

a sheet of fabric, the sheet of fabric having dimensions suitable for covering a substantial portion of a person;

a pocket attached to a surface of the sheet of fabric, the pocket having an opening and an interior region;

an amusement figure positioned within the interior region of the pocket and having at least a portion of the amusement figure extending beyond the opening, a lower portion of the amusement figure being permanently attached to the sheet of fabric, the amusement figure being configured with enough material to enable limited range movement of the amusement figure outside of the opening.

2. The blanket as claimed in claim 1 further including a button permanently attached to the sheet of fabric and residing within the interior region of the pocket, the button being operable through corresponding buttonholes in said amusement figure and an outer surface of said pocket to retain the amusement figure in the pocket.

3. The blanket as claimed in claim 1 wherein the amusement figure includes at least two buttonholes.

4. The blanket as claimed in claim 1 wherein the portion of the amusement figure positioned within the pocket is fabricated from a cloth material.

5. The blanket as claimed in claim 1 wherein the shape of the pocket is substantially rectangular.

6. The blanket as claimed in claim 1 wherein the shape of the pocket is substantially circular.

7. The blanket as claimed in claim 1 wherein the shape of the pocket is substantially triangular.

8. A blanket comprising:

a sheet of fabric, the sheet of fabric having dimensions suitable for covering a substantial portion of a person;

a pocket attached to a surface of the sheet of fabric, the pocket having an opening and an interior region; and a stuffed animal positioned within the interior region of the pocket and having at least a portion of the stuffed animal extending beyond the opening, a lower portion of the stuffed animal being permanently attached to the sheet of fabric, the stuffed animal being configured with enough material to enable limited range movement of the stuffed animal outside of the opening.

9. The blanket as claimed in claim 8, further including a button permanently attached to the sheet of fabric and residing within the interior region of the pocket, the button being operable through corresponding buttonholes in said stuffed animal and an outer surface of said pocket to retain the stuffed animal in the pocket.

10. The blanket of claim 8, wherein the stuffed animal includes at least one buttonhole.

11. A blanket comprising:

a sheet of fabric, the sheet of fabric having dimensions suitable for covering a substantial portion of a person;

a pocket attached to a surface of the sheet of fabric, the pocket having an opening and an interior region; and a doll positioned within the interior region of the pocket and having at least a portion of the doll extending beyond the opening, a lower portion of the doll being permanently attached to the sheet of fabric, the doll being configured with enough material to enable limited range movement of the doll outside of the opening.

12. The blanket as claimed in claim 11, further including a button permanently attached to the sheet of fabric and residing within the interior region of the pocket, the button being operable through corresponding buttonholes in said doll and an outer surface of said pocket to retain the doll in the pocket.

13. The blanket of claim 11, wherein the doll includes at least one buttonhole.

14. A blanket comprising:

a pocket attached to a surface of the blanket, the pocket having an opening and an interior region;

an amusement figure positioned within the interior region of the pocket and having at least a portion of the amusement figure extending beyond the opening, a lower portion of the amusement figure being permanently attached to the blanket, the amusement figure being configured with enough material to enable limited range movement of the amusement figure outside of the opening; and a button permanently attached to the blanket and residing within the interior region of the pocket, the button being operable through corresponding buttonholes in said amusement figure and an outer surface of said pocket to retain the amusement figure in the pocket.

15. The blanket as claimed in claim 14, wherein the portion of the amusement figure positioned within the pocket is fabricated from a cloth material.

* * * * *